US009447555B2

(12) United States Patent
Abdullah et al.

(10) Patent No.: US 9,447,555 B2
(45) Date of Patent: Sep. 20, 2016

(54) GEOPOLYMERIZATION METHOD FOR SOIL STABILIZATION APPLICATION

(71) Applicant: KING ABDUL AZIZ CITY SCIENCE & TECHNOLOGY (KACST), Riyadh (SA)

(72) Inventors: Mohd Mustafa Al Bakri Abdullah, Kangar (MY); Muhammad Faheem Mohd Tahir, Kangar (MY); Kamarudin Hussin, Kangar (MY); Sharifah Zaliha Syed Zuber, Kangar (MY); Alida Abdullah, Kangar (MY); Muhd Izzat Ahmad, Kangar (MY); Che Mohd Ruzaidi Ghazali, Kangar (MY); Fauziah Ahmad, Nibong Tebal (MY); Mohammed Binhussain, Riyadh (SA)

(73) Assignee: King Abdulaziz City for Science and Technology (KACST), Riyadh (SA)

( * ) Notice: Subject to any disclaimer, the term of this patent is extended or adjusted under 35 U.S.C. 154(b) by 0 days.

(21) Appl. No.: 14/327,392

(22) Filed: Jul. 9, 2014

(65) Prior Publication Data

US 2015/0016895 A1 Jan. 15, 2015

(51) Int. Cl.
*E02D 3/00* (2006.01)

(52) U.S. Cl.
CPC ..... *E02D 3/00* (2013.01)

(58) Field of Classification Search
CPC ..... E02D 3/00; C04B 28/008
See application file for complete search history.

(56) References Cited

U.S. PATENT DOCUMENTS

| | | | | |
|---|---|---|---|---|
| 4,107,112 | A * | 8/1978 | Latta, Jr. | C09K 17/18 166/195 |
| 5,494,514 | A * | 2/1996 | Goodson | C04B 28/02 106/672 |
| 6,076,997 | A * | 6/2000 | First | C04B 24/163 106/900 |
| 2011/0305101 | A1* | 12/2011 | Brouillette | B01F 3/12 366/34 |
| 2012/0156381 | A1* | 6/2012 | Allouche | C04B 28/006 427/377 |
| 2012/0255462 | A1* | 10/2012 | Gasafi | C04B 7/30 106/692 |
| 2013/0061776 | A1* | 3/2013 | Allouche | C04B 28/008 106/624 |

OTHER PUBLICATIONS

Mustafa et al.; Fly Ash Porous Material using Geopolymerization Process for High Tempterature Exposure; Apr. 10, 2012; Internation Journal of Molecular Sciences.*

* cited by examiner

*Primary Examiner* — Benjamin Fiorello
(74) *Attorney, Agent, or Firm* — Timberline Patent Law Group PLLC

(57) ABSTRACT

A method of soil stabilization includes mixing a geopolymer material with an alkaline activator and adding 5 to 30 percent by weight of the mixture to a soil.

8 Claims, 1 Drawing Sheet

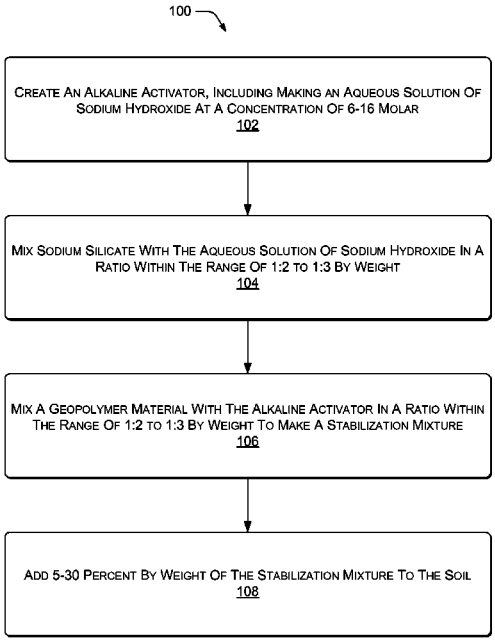

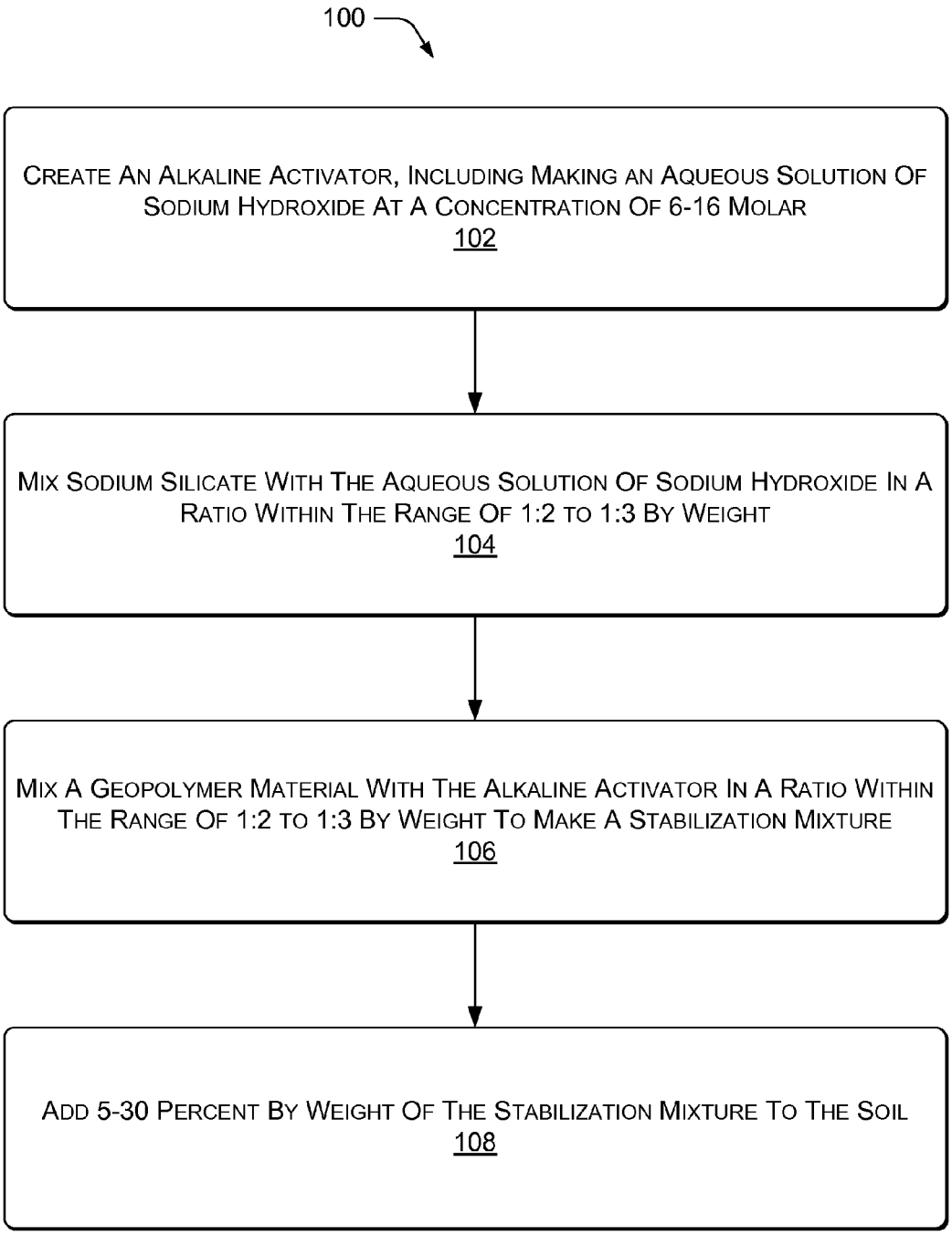
100
Create An Alkaline Activator, Including Making an Aqueous Solution Of Sodium Hydroxide At A Concentration Of 6-16 Molar
102
Mix Sodium Silicate With The Aqueous Solution Of Sodium Hydroxide In A Ratio Within The Range Of 1:2 to 1:3 By Weight
104
Mix A Geopolymer Material With The Alkaline Activator In A Ratio Within The Range Of 1:2 to 1:3 By Weight To Make A Stabilization Mixture
106
Add 5-30 Percent By Weight Of The Stabilization Mixture To The Soil
108

GEOPOLYMERIZATION METHOD FOR SOIL STABILIZATION APPLICATION

FIELD OF INVENTION

This present invention relates to a method for chemical soil stabilization. In particular, the method comprises a geopolymerization process to provide a soil stabilizer from geopolymeric materials obtained from industrial or agricultural wastes.

BACKGROUND OF THE INVENTION

Soil stabilization is the modification of one or more soil properties in order to obtain a soil material that remains in an unchanged condition throughout its service life. Soils may be stabilized to increase strength and durability, to reduce plasticity or the soil is stabilized to prevent erosion and dust generation. Two broad categories for methods of soil stabilization include mechanical stabilization and chemical stabilization.

Chemical stabilization mainly depends on chemical reactions between a stabilizer (cementitious material) and soil minerals (pozzolanic materials). Conventional chemical stabilization uses cement, lime, fly ash, bitumen or combination of these as soil stabilizer. Nevertheless, stabilizers based on natural resources or industrial wastes are focused to conserve energy and natural resources such as petroleum. On the other hand, the use of natural resources or industrial wastes is expected to prevent pollution resulting from manufacture of cement.

Some conventional references employ natural resources or industrial wastes as soil stabilizers to provide sustainable development in the construction industry.

Hossain et al. (2007) discloses the use of volcanic ash, lime, cement and their combinations to stabilize clayey soils. Hossain et al. (2011) also reveals the use of cement kiln dust, volcanic ash, and their combinations to stabilize clayey soils.

Further, Tuncer B. Edil et al. (2006) discloses the use of fly ash to stabilize soft fine-grained soils. Amzar et al. reveals the use of palm oil fuel ash as a soil stabilizer for clay liner for landfill construction.

However, the methods for soil stabilization involved in the conventional art mentioned above basically mix and compact the soil and stabilizers. The stabilizers are selected only for particle size and the relative amount used. Although the resulting soil may be high in mechanical strength, may not be chemically stable to withstand severe conditions such as in the presence of acid rain or industrial effluents. Hence, a chemically stable yet environmentally friendly soil stabilizing method is desired to modify weak or soft soils for the use in construction applications.

SUMMARY OF THE INVENTION

The object of the present invention is to provide a method of soil stabilization that employs geopolymer as soil stabilizer for soft soils.

The object of the present invention is to provide a method of soil stabilization that employs environmentally friendly raw materials as stabilizers including fly ash, kaolin, metakaolin, palm oil fly ash, volcanic ash or any combination thereof.

Another object of the present invention is to provide a method of soil stabilization that is able to wholly replace the use of cement as conventional soil stabilizer.

Still, one object of the present invention is to provide a method of soil stabilization that is applicable to all kinds of soft soils.

Another object of the invention is to provide a method of soil stabilization that is low in cost as the raw materials are obtained from industrial and agricultural waste.

At least one of the preceding objects is met, in whole or in part, by the present invention, in which the embodiment of the present invention describes a method of soil stabilization comprising the steps of mixing geopolymer material with alkaline activator in a desired ratio and adding 5 to 30 wt % of the mixture to the soil.

One skilled in the art will readily appreciate that the present invention is well adapted to carry out the objects and obtain the ends and advantages mentioned, as well as those inherent therein. The embodiments described herein are not intended as limitations on the scope of the invention as well as not limited to what are described herein.

BRIEF DESCRIPTION OF THE DRAWING

FIG. 1 is a flow diagram of an example method of stabilizing a soil.

DETAILED DESCRIPTION OF THE INVENTION

The present invention discloses a method of soil stabilization comprising the steps of mixing geopolymer material with alkaline activator in a desired ratio and adding 5 to 30 wt % of the mixture to the soil.

The geopolymer material employed can be any pozzolanic material that complies with the standard of ASTM C618 as a pozzolanic material that contains siliceous or siliceous and aluminious material. The geopolymer material can be any pozzolanic material that is able to react with alkali activator to form Si—O—Al bond structure. Furthermore, geopolymer material which possess natural or artificial thermal history is preferably used.

In one of the preferred embodiment, the geopolymer material is obtained from natural resources. Also in the preferred embodiment, the geopolymer material is obtained from agricultural or industrial waste.

Preferably, the industrial waste employed in the present invention is fly ash, metakaolin or any combination thereof. However, bottom ash can also be utilized. The geopolymer material obtained from natural resources is preferably kaolin, metakaolin, volcanic ash or any combination thereof. In the preferred embodiment, the industrial waste employed is having 48 to 52 wt % of silica, whereas the natural resources of geopolymer material is having 50 to 54 wt % of silica which is almost the same with industrial waste.

The agricultural waste employed in the present invention is preferably a palm oil fly ash (POFA). Nevertheless, agricultural waste such as wood ash, rice-husk ash, sawdust ash or bagasse ash can also be used. In the preferred embodiment, the agricultural waste employed is having 50 to 65 wt % of silica.

In one of the preferred embodiments, fly ash, kaolin, metakaolin, palm ash, volcanic ash or any combination thereof is the preferred geopolymer material. The geopolymer material essentially reacts with an alkaline activator to form a geopolymer-based soil stabilizer.

Preferably, the ratio of geopolymer material to alkaline activator is in a range from 0.5:1 to 1:3 depending on the geopolymer materials used. In the preferred embodiment, the geopolymer material is preferably employed in its solid state. The geopolymer material can be employed in powder, pellets, beads or ash. On the other hand, the alkaline activator is prepared as a liquid. In the preferred embodiment, the alkaline activator is a mixture comprising sodium silicate and sodium hydroxide. Nevertheless, potassium hydroxide or calcium hydroxide can also be employed in order to provide an alkali environment for geopolymerization reaction.

Water content in the alkaline activator liquid is an important factor in geopolymerization. If the water content is too high, the geopolymerization process may be hindered.

It is also important to note that the ratio of sodium silicate to sodium hydroxide is essential to form a workable soil stabilizer. An increase in ratio of sodium silicate to sodium hydroxide enables an increase in $SiO_2$ species, leading to an increase in the ratio of $SiO_2/Al_2O_3$. Hence, more Si—O—Si bonds are formed, where the Si—O—Si bonds are stronger in comparison with Si—O—Al bonds.

Furthermore, the increase in ratio of sodium silicate to sodium hydroxide significantly increases the geopolymerization rate, providing a rapid increase in strength of a resulting geopolymer-based soil stabilizer.

In the preferred embodiment, the sodium hydroxide, potassium hydroxide or calcium hydroxide can be prepared in a concentration range from 6 M to 16 M. Further in the preferred embodiment, the sodium silicate to sodium hydroxide can be prepared in a ratio from 0.5:1 to 1:3.

Thus, in an implementation, a method for stabilizing a soil includes making an alkaline activator, including making an aqueous solution of a metal-hydroxide at a concentration within a range from approximately 6 molar to approximately 16 molar, and mixing sodium silicate with the solution of metal-hydroxide in a ratio within a range from approximately 1:2 to approximately 1:3 by weight. The metal hydroxide can be one of sodium hydroxide, potassium hydroxide, or calcium hydroxide. Then a geopolymer material is mixed with the alkaline activator in a ratio within a range from approximately 1:2 to approximately 1:3 by weight to make a stabilization mixture, and 5-30 percent by weight of the stabilization mixture is added to the soil.

FIG. 1 shows an example method 100 of stabilizing a soil. Operations are shown in individual blocks.

At block 102, an alkaline activator is created, including making an aqueous solution of sodium hydroxide at a concentration of 6-16 molar.

At block 104, sodium silicate is mixed with the aqueous solution of sodium hydroxide in a ratio within the range of 1:2 to 1:3 by weight.

At block 106, a geopolymer material is mixed with the alkaline activator in a ratio within the range of 1:2 to 1:3 by weight to make a stabilization mixture.

At block 108, 5-30 percent by weight of the stabilization mixture is added to the soil.

Pursuant to the preferred embodiment, the geopolymer-based soil stabilizer is added to a soft soil and preferably mixed for the stabilization process. Mixing can be performed in a stirrer or mixer to obtain a homogeneous mixture. However, it can also be mixed manually by hand on a small scale.

Soft soil or weak soil is preferably stabilized to enhance its durability such as water absorption, compressive strength and linear shrinkage. Soft soils such as clay soil, peat soil, organic soil or any combination thereof can be modified for construction applications despite its original undesired properties.

In one of the preferred embodiments, the strength of a soft soil can be increased by at least 10 MPa by using the geopolymer soil stabilizer in the present invention. A soft soil having unconfined compressive strength of 3 MPa is being stabilized by mixing with a geopolymer soil stabilizer described in the present invention. The strength of the stabilized soil after stabilization is 14 MPa.

One advantages of applying the mentioned geopolymer-based soil stabilizer in the present invention is that the choice of soil is non-selective. All kinds of soil can be stabilized for customized purposes. The stabilized soil is essentially chemically stable due to the presence of Si—O—Si bonds and Si—O—Al bonds. Hence the stabilized soil will remain in an unchanged condition throughout its service life. It is because the properties of the geopolymer itself are good which is a good chemical resistance.

The present disclosure includes content as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. A method of soil stabilization comprising the steps of:

forming a mixture by mixing a geopolymer material with an alkaline activator in a ratio in a range from 0.5:1 to 1:3 by weight, wherein the geopolymer material is fly ash, kaolin, metakaolin, palm ash, volcanic ash or any combination thereof;

wherein the alkaline activator comprises sodium silicate and sodium hydroxide in a ratio from 1:2 to 1:3 by weight, the sodium hydroxide having a concentration in a range of 6 M to 16 M;

and adding 5 to 30 wt % of the mixture to a soil with a compressive strength of approximately 3 MPa to form a chemical-resistant stabilized soil with a compressive strength of approximately 14 MPa for construction.

2. A method according to claim 1, wherein the soil is soft soil.

3. A method according to claim 2, wherein the soft soil is clay soil, peat soil, organic soil or any combination thereof.

4. A method for stabilizing a soil, comprising:

making an alkaline activator, including:

making an aqueous solution of a metal hydroxide at a concentration within a range from approximately 6 molar to approximately 16 molar;

mixing sodium silicate with the solution of the metal hydroxide in a ratio, the ratio within a range from approximately 1:2 to approximately 1:3;

mixing a geopolymer material with the alkaline activator in a ratio within a range from approximately 1:2 to approximately 1:3 by weight to make a stabilization mixture; and adding 5-30 percent by weight of the stabilization mixture to the soil to create Si—O—Si and Si—O—Al bonds in the soil for decreasing water absorption and linear shrinkage and for increasing chemical resistance and compressive strength of the soil for construction.

5. The method according to claim 4, wherein the geopolymer material is fly an ash, a kaolin, a metakaolin, a palm ash, a volcanic ash or a combination thereof.

6. The method of claim 4, wherein the metal hydroxide is selected from the group consisting of sodium hydroxide, potassium hydroxide, and calcium hydroxide.

7. The method according to claim 4, wherein the soil is soft soil.

8. The method according to claim 7, wherein the soft soil is a clay soil, a peat soil, an organic soil or a combination thereof.

* * * * *